US005082193A

United States Patent [19]

Boni

[11] Patent Number: 5,082,193

[45] Date of Patent: Jan. 21, 1992

[54] THREAD GUIDING UNIT WITH AUTOMATIC CONTROL PARTICULARLY FOR SPOOLING MACHINES

[76] Inventor: Romano Boni, Via Umberto I, 10, 25023 Gottolengo (Province of Brescia), Italy

[21] Appl. No.: 536,364

[22] Filed: Jun. 11, 1990

[30] Foreign Application Priority Data

Jun. 20, 1989 [IT] Italy ..... 20930 A/89

[51] Int. Cl.[5] ..... B65H 54/28

[52] U.S. Cl. ..... 242/158 R; 242/25 R; 242/158.4 R

[58] Field of Search ..... 242/158 R, 158.1, 158.2, 242/158.4 R, 25 R

[56] References Cited

U.S. PATENT DOCUMENTS

| | | | |
|---|---|---|---|
| 2,779,544 | 1/1957 | Hafer | 242/25 R |
| 3,218,004 | 11/1965 | Meeske et al. | 242/158.2 |
| 3,240,438 | 3/1966 | Baselice | 242/25 R |
| 4,093,146 | 6/1978 | Haley | 242/158.2 |
| 4,271,384 | 6/1981 | Beling . | |
| 4,283,020 | 8/1981 | Bauer et al. | 242/25 R |

FOREIGN PATENT DOCUMENTS

| | | | |
|---|---|---|---|
| 273744 | 11/1989 | Fed. Rep. of Germany . | |
| 22858 | 2/1984 | Japan | 242/25 R |
| 243773 | 10/1986 | Japan | 242/25 R |
| 899531 | 6/1962 | United Kingdom | 242/158 R |

*Primary Examiner*—Stanley N. Gilreath
*Attorney, Agent, or Firm*—Guido Modiano; Albert Josif

[57] ABSTRACT

The present invention relates to a thread guiding unit with automatic control, particularly for spooling machines, which has a supporting frame bearing a rod. The rod supports a thread guide and is reciprocatingly movable along a direction which is parallel to the axis of a yarn spooling reel supported by the spooling machine. A step motor is furthermore provided for the actuation of the rod and is activated by stroke limit sensors which interact with an abutment associated with the rod.

18 Claims, 2 Drawing Sheets

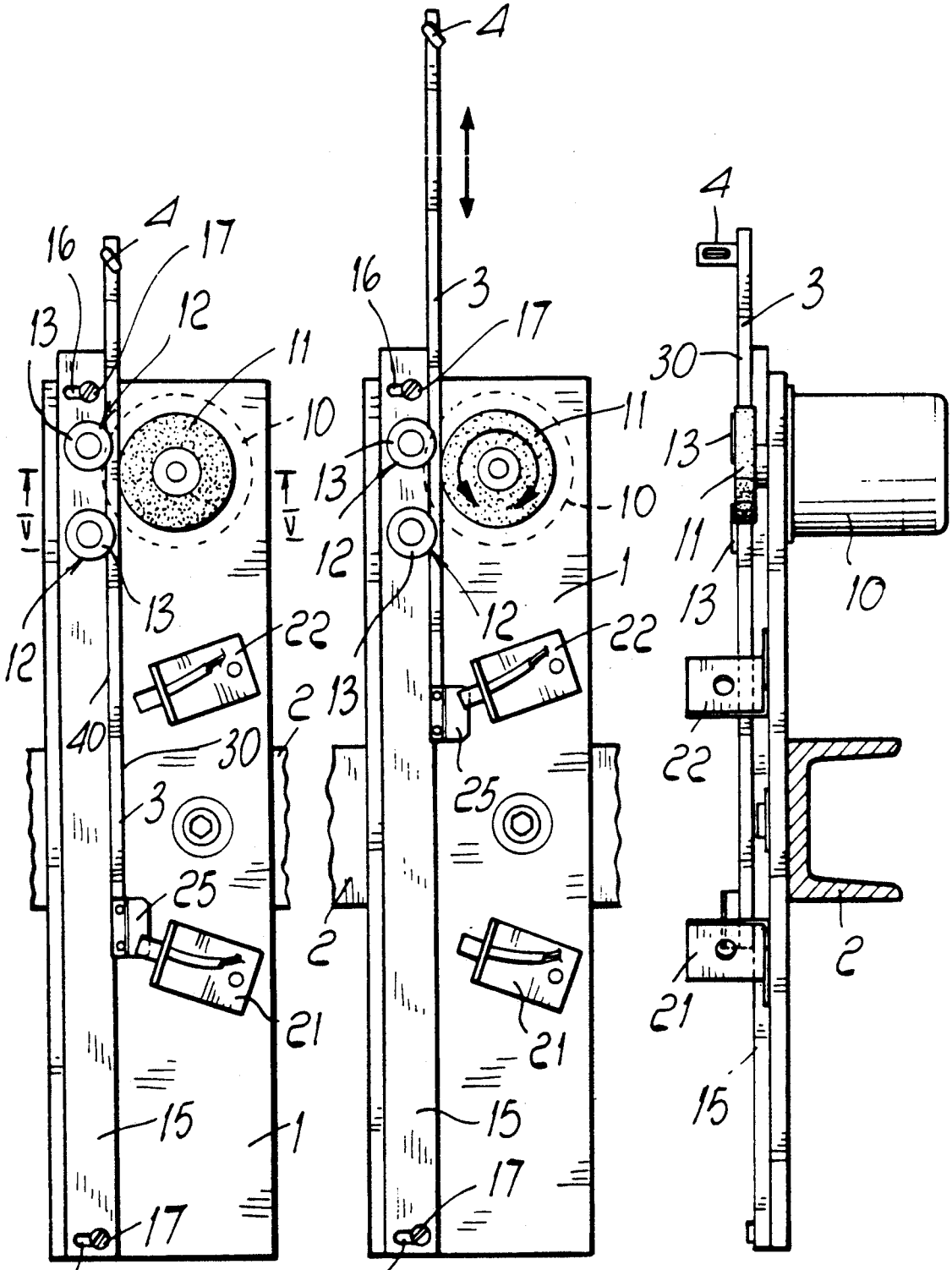
16 Fig. 4 16 Fig. 6 Fig. 7

THREAD GUIDING UNIT WITH AUTOMATIC CONTROL PARTICULARLY FOR SPOOLING MACHINES

BACKGROUND OF THE INVENTION

The present invention relates to a thread guiding unit with automatic control particularly for spooling machines.

As known, thread guides are used in spooling machines and move the thread with respect to the reel so as to obtain a uniform winding of the thread on the axial extension of the reel.

Thread guide moving units currently in use are manufactured according to the most disparate constructive criteria and among these mention is made of thread guides constituted by an oscillating lever which is actuated by means of cams.

This kind of thread guide is considerably complicated from a mechanical point of view and furthermore does not allow to obtain a good thread spooling speed due to the impossibility of mechanically following the possible spooling speed of the thread on the reel.

Another disadvantage observed with known thread guiding units is furthermore constituted by the fact that winding imperfections very frequently occur at the axial ends of the reel being spooled, proximate to the flanges of said reel; said imperfections can be constituted by an excess of thread, with consequent widening of the reel, or by a lack of thread, with consequent undue narrowing of the reel at the axial ends.

On the other hand it is extremely difficult, if not impossible in many cases, to precisely adjust the position of the thread, especially at the axial ends.

Other difficulties arise in correctly adjusting the excursion of the thread guide, i.e. its movement from one end of the reel to the other to provide the oscillation reversal which allows to obtain a uniform spooling of the reel.

SUMMARY OF THE INVENTION

The aim proposed by the invention is indeed to eliminate the disadvantages described above by providing a thread guiding unit with automatic control, particularly for spooling machines, which performs the alternated movement of the thread guide in extremely short times which are such as to allow an increase in the spooling speed of the thread on the reel with respect to currently usable speeds.

Within the scope of the above described aim, a particular object of the invention is to provide a thread guiding unit which allows to adjust in an extremely rapid manner the stroke limit stop of the alternated movement of the thread guide, thus obtaining a perfectly uniform spooling of the thread or yarn on the reel.

Another object of the present invention is to provide a thread guiding unit which allows to effect, according to a presettable logic and variably according to presettable criteria, the alternation of the strokes of the thread guide so as to prevent the occurrence of spooling defects at the axial ends of the reel.

A further object of the present invention is to provide a thread guiding unit which is very compact from a dimensional point of view and can be easily applied at each reel, with the advantage of being able to perform adjustments which can vary from one reel to the other.

This aim, these objects and others which will become apparent hereinafter are achieved by a thread guiding unit with automatic control, particularly for spooling machines, according to the invention, characterized in that it comprises, on a supporting frame, a rod for the thread guide which is alternately movable along a direction which is substantially parallel to the axis of a reel for the spooling of the yarn, a step motor for the actuation of said rod being furthermore provided, said motor being driven by stroke limit sensors which interact with an abutment associated with said rod.

BRIEF DESCRIPTION OF THE DRAWINGS

Further characteristics and advantages will become apparent from the description of a preferred but not exclusive embodiment of a thread guiding unit with automatic control, particularly for spooling machines, illustrated only by way of non-limitative example in the accompanying drawings, wherein:

FIG. 4 is a front view of the thread guiding unit;

FIG. 6 is a schematic front view of the thread guiding unit with the thread guiding rod in raised position;

FIG. 7 is a schematic side view of the thread guiding unit.

DESCRIPTION OF THE PREFERRED EMBODIMENTS

Figure 1:
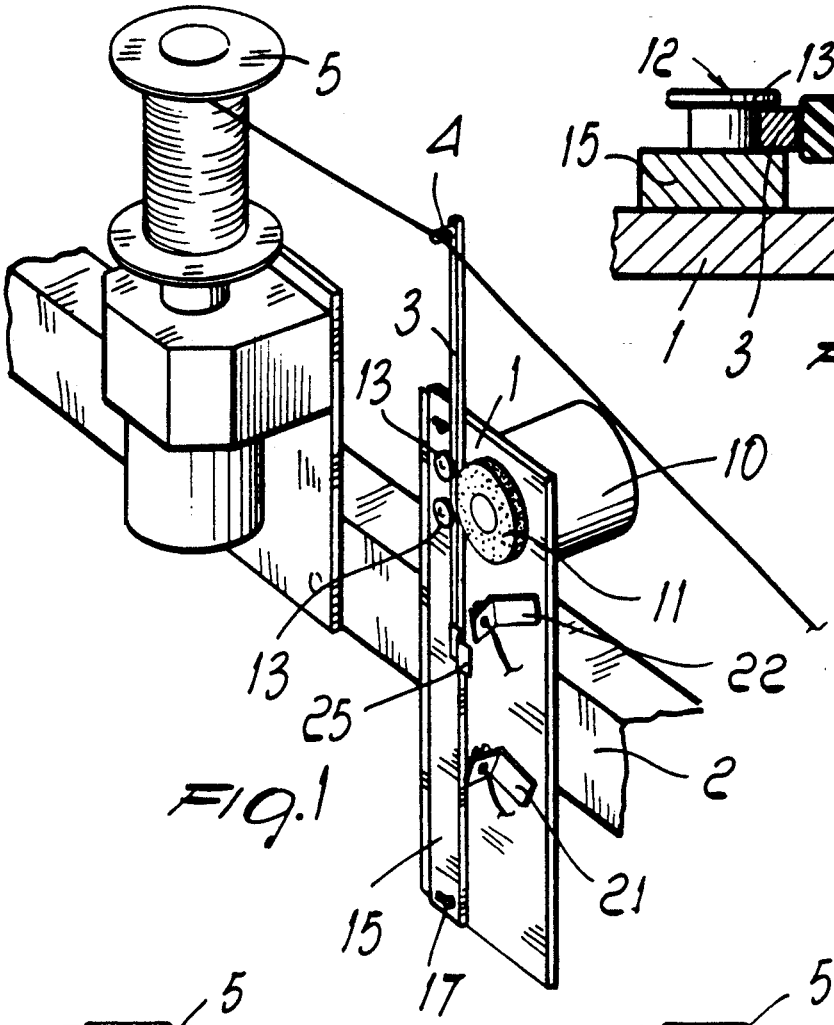
FIG. 1 is a schematic perspective view of the thread guiding unit applied to a spooling machine.
Figure 5:
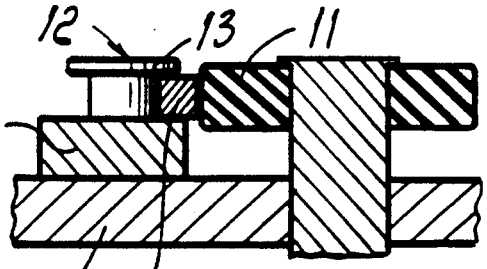
FIG. 5 is a sectional view taken along the line V—V of FIG. 4.
Figure 2:
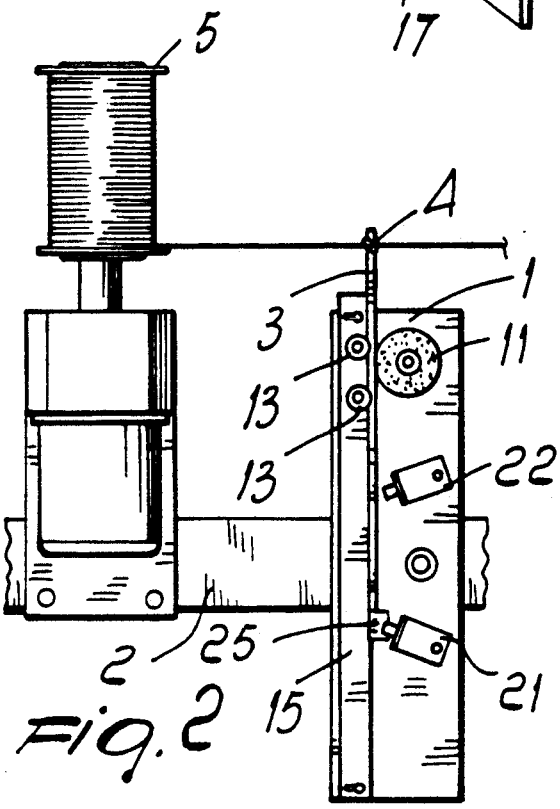
FIGS. 2 and 3 are schematic views of the thread guiding unit applied to a spooling machine, shown with the thread guide arranged at the ends of its stroke.
Figure 3:
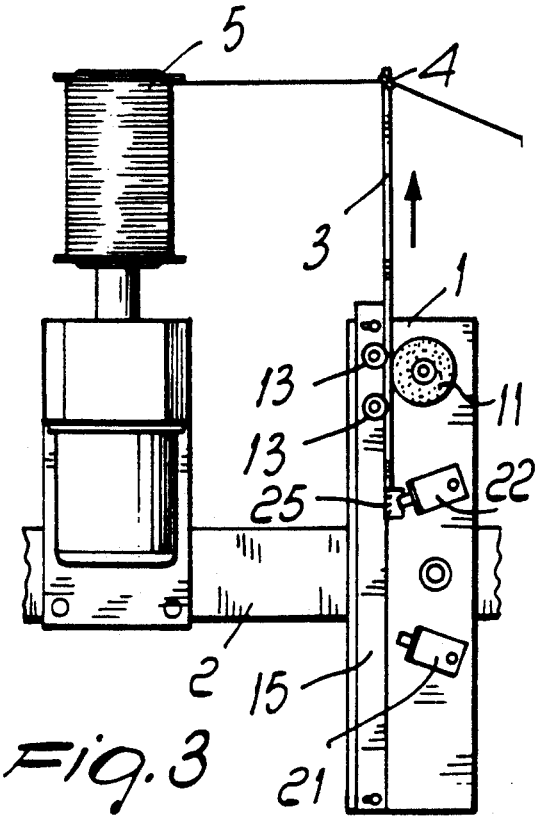

With reference to the above figures, the thread guiding unit with automatic control, particularly for spooling machines, according to the invention, comprises a supporting frame, constituted by a plate 1, which is rigidly associable with a frame of the spooling machine, generally indicated by the reference numeral 2.

A rod 3, supported on the plate 1, is movable with a reciprocating motion and supports a thread guide 4.

The rod 3 is reciprocatingly movable along a direction which is substantially parallel to the axis of the reel 5, which is supported by the spooling machine in a per se known manner.

The alternated or reciprocating sliding of the rod 3 is performed by virtue of motor means which are constituted by a step motor 10 which is supported by the plate 2 and actuates a control wheel 11 advantageously made of elastically yielding material.

The control wheel 11 engages by contact with a first lateral edge 30 of the rod 3, which is retained by means of abutment rollers 12, which engage by contact with a second lateral edge 40 of the rod 3 (see FIG. 4). The rollers are arranged so as to be mutually spaced and provided with a flange-like wing 13 which partially overlaps the rod 3.

The respective axes of the rollers 12 are aligned along a direction which is parallel to the direction of sliding of the rod 3 and are arranged so as to be mutually spaced so that the control wheel 11 engages the rod 3 by contact so as to provide support for the rod 3 on three spaced and non-aligned points.

The rollers 12 are rotatably supported by a bar 15 which can be fixed to the plate 1 with the possibility of positioning it along a direction which is perpendicular to the direction of motion of the rod 3.

Positioning is obtained by means of slots 16 which are defined on the supporting bar 15 and allow the passage of fixing screws 17 for connecting the supporting bar 15 to the plate 1.

The step motor 10 is activated by stroke limit sensors which are advantageously constituted by a first sensor or lower sensor 21 and by second sensor or upper sensor 22 which can be of any kind, such as one or more photocells, optical sensors, magnetic sensors and the like.

By means of a program which can be varied in each instance according to the spooling requirements, the sensors 21 and 22 in practice determine the stroke limit conditions of the reciprocating sliding of the rod 3, with the possibility of conditioning the lower and upper stroke limits according to a presettable cycle or in any case according to a presettable logic, so as to obtain the correct spooling of the yarn in the most critical regions of the reel, which are notoriously constituted by the axial ends proximate to the flanges of said reel.

The sensors 21 and 22 are activated by an abutment 25 which interacts with said sensors and is rigidly connected to the rod 3.

In practical operation, the interaction between the abutment 25 and one of the sensors activates the reverse motion of the step motor according to the stroke limit conditions imposed by the presettable logic which can be set for controlling the step motor, via a program as cited heretofore.

The use of a step motor allows to follow with extreme speed and precision the reciprocating movements of the rod, and the particular mechanical coupling, provided by means of the elastically yielding wheel 11 and the abutment rollers 12, furthermore allows to perform an extremely precise sliding in both directions, with the possibility of providing the stroke limit stop at the precisely determined point.

It should be furthermore added that the elastic yielding of the control wheel 11 in practice allows, by acting on the mutual position of the rollers 12 which can be moved in a direction which is perpendicular to the direction of movement of the rod, to vary the useful diameter of said control wheel and in practice obtain a further adjustment of the translatory motion according to the number of turns of the step motor.

From what has been described above it can thus be seen that the invention achieves the proposed aim and objects and in particular the fact is stressed that the use of a thread guiding unit, wherein the thread guide supporting rod is actuated by means of a step motor, allows to significantly increase the spooling speed of the spooling machine, since the thread guide is capable of performing movements at a speed which is considerably higher than that which can be achieved with conventional mechanical thread guiding units.

The invention thus conceived is susceptible to numerous modifications and variations, all of which are within the scope of the inventive concept.

All the details may furthermore be replaced with other technically equivalent elements.

In practice, the materials employed, as well as the contingent shapes and dimensions, may be any according to the requirements.

I claim:

1. Thread guiding unit comprising;

at least one plate associable with a spooling machine frame, at least one bar connected to said plate, at least two rollers mounted on said bar, a step motor connected to said plate, at least one control wheel driven by said step motor, at least one rod located on said bar, a first lateral edge defined by said rod and being in contact engagement with said control wheel, a second lateral edge defined by said bar and being in contact engagement with said rollers, a direction of movement defined by said rod upon activating said step motor, at least one thread guide supported by said rod, at least one abutment supported by said rod, a second stroke limit sensor connected to said plate and reversing the direction of motion of said step motor upon being contacted by said abutment, and a first stroke limit sensor connected to said plate and being spaced from said second stroke limit sensor, said first stroke limit sensor reversing the direction of motion of said step motor upon being contacted by said abutment, wherein said control wheel is made of an elastically yielding material, and means for releasably connecting said bar to said plate for movement of said bar in a direction perpendicular to said direction of movement defined by said rod.

2. Thread guide unit according to claim 1, further comprising at least one flange-like wing defined on each of said rollers, and wherein said rod is located between said bar and said flange-like wing of each of said rollers.

3. Thread guide unit according to claim 1, wherein said rollers are spaced apart, and wherein said control wheel is centered between said rollers and spaced therefrom by said rod.

4. Thread guide unit according to claim 1, wherein said means for releasably connecting said bar to said plate comprises a plurality of slots formed in said bar, and fixing means located at each slot for movably connecting said bar to said plate.

5. Thread guide unit according to claim 4, wherein said fixing means comprise screws, and wherein said slots are elongated in a direction which is perpendicular to said direction of movement defined by said rod.

6. Thread guide unit according to claim 1, wherein said second stroke limit sensor and said first stroke limit sensor are connected to said plate below said control wheel.

7. Thread guide unit according to claim 1, wherein said rollers and said control wheel engage said rod between said thread guide and said abutment.

8. Thread guiding unit comprising;

at least one plate associable with a spooling machine frame, at least one bar connected to said plate, at least two rollers mounted on said bar, at least one flange-like wing defined on each of said rollers, a step motor connected to said plate, at least one control wheel driven by said step motor and defining a control wheel diameter, at least one rod located between said bar and said flange like wing of each of said rollers, a first lateral edge defined by said rod and being in contact engagement with said control wheel, a second lateral edge defined by said bar and being in contact engagement with said rollers, a direction of movement defined by said rod upon activating said step motor, at least one thread guide supported by said rod, at least one abutment supported by said rod, a second stroke limit sensor connected to said plate and reversing the direction of motion of said step motor upon being contacted by said abutment, a first stroke limit sensor connected to said plate and being spaced from said second stroke limit sensor, said first stroke limit sensor reversing the direction of motion of said step motor upon being contacted by said abutment, wherein said control wheel is made of an elastically yielding material, and means for releasably connecting said bar to said plate for movement of said bar in a direction perpendicular to said direction of movement defined by said rod, whereby to vary said control wheel diameter.

9. Thread guide unit according to claim 8, wherein said rollers are spaced apart, and wherein said control wheel is centered between said rollers and spaced therefrom by said rod.

10. Thread guide unit according to claim 8, wherein said means for releasably connecting said bar to said plate comprises a plurality of slots formed in said bar, and fixing means located at each slot for movably connecting said bar to said plate.

11. Thread guide unit according to claim 8, wherein said fixing means comprise screws, and wherein said slots are elongated in a direction which is perpendicular to said direction of movement defined by said rod.

12. Thread guide unit according to claim 8, wherein said second stroke limit sensor and said first stroke limit sensor are connected to said plate below said control wheel.

13. Thread guide unit according to claim 8, wherein said rollers and said control wheel engage said rod between said thread guide and said abutment.

14. Thread guiding unit comprising;

at least one plate associable with a spooling machine frame, at least one bar connected to said plate, at least two rollers mounted on said bar, at least one flange-like wing defined on each of said rollers, a step motor connected to said plate, at least one control wheel driven by said step motor and defining a control wheel diameter, at least one rod located between said bar and said flange like wing of each of said rollers, a first lateral edge defined by said rod and being in contact engagement with said control wheel, a second lateral edge defined by said bar and being in contact engagement with said rollers, a direction of movement defined by said rod upon activating said step motor, at least one thread guide supported by said rod, at least one abutment supported by said rod, a second stroke limit sensor connected to said plate and reversing the direction of motion of said step motor upon being contacted by said abutment, a first stroke limit sensor connected to said plate and being spaced from said second stroke limit sensor, said first stroke limit sensor reversing the direction of motion of said step motor upon being contacted by said abutment, wherein said control wheel is made of an elastically yielding material, means for releasably connecting said bar to said plate for movement of said bar in a direction perpendicular to said direction of movement defined by said rod, whereby to vary said control wheel diameter, and wherein said rollers are spaced apart and said control wheel is centered between said rollers and spaced therefrom by said rod.

15. Thread guide unit according to claim 14, wherein said means for releasably connecting said bar to said plate comprises a plurality of slots formed in said bar, and fixing means located at each slot for movably connecting said bar to said plate.

16. Thread guide unit according to claim 14, wherein said fixing means comprises screws, and wherein said slots are elongated in a direction which is perpendicular to said direction of movement defined by said rod.

17. Thread guide unit according to claim 14, wherein said second stroke limit sensor and said first stroke limit sensor are connected to said plate below said control wheel.

18. Thread guide unit according to claim 14, wherein said rollers and said control wheel engage said rod between said thread guide and said abutment.

* * * * *